United States Patent [19]

Calvert

[11] 4,389,832

[45] Jun. 28, 1983

[54] METHOD AND APPARATUS FOR LOADING BOTTLES INTO OPEN TOP BOTTLE CARRIERS

[75] Inventor: Rodney K. Calvert, Dunwoody, Ga.

[73] Assignee: The Mead Corporation, Dayton, Ohio

[21] Appl. No.: 244,163

[22] Filed: Mar. 16, 1981

[51] Int. Cl.[3] ..... B65B 21/04; B65B 21/16

[52] U.S. Cl. ..... 53/48; 53/534; 53/536; 53/539; 53/241; 53/247; 53/248; 53/251

[58] Field of Search ..... 53/48, 534, 536, 539, 53/241, 248, 247, 251, 246; 198/841

[56] References Cited

U.S. PATENT DOCUMENTS

| | | | |
|---|---|---|---|
| 830,669 | 9/1906 | Menard | 198/841 |
| 2,587,953 | 3/1952 | Arneson | 53/534 |
| 2,853,177 | 9/1958 | Engleson | 53/236 X |
| 2,978,854 | 4/1961 | Fairest | 53/539 X |
| 3,141,274 | 7/1964 | Nigrelli | 53/48 |
| 3,230,354 | 2/1966 | Wood | 198/841 |
| 3,377,774 | 4/1968 | Nigrelli | 53/534 X |
| 3,417,540 | 12/1968 | Copping | 53/48 |
| 3,531,911 | 10/1970 | Gianese | 53/536 X |
| 3,599,397 | 8/1971 | Standley | 53/534 X |
| 3,601,952 | 8/1971 | Cato | 53/534 X |
| 3,653,178 | 4/1972 | Bauer | 53/248 X |
| 3,805,476 | 4/1974 | Kawamura | 53/539 |
| 3,866,392 | 2/1975 | Weeks | 53/246 X |
| 4,237,673 | 12/1980 | Calvert | 53/48 |
| 4,285,185 | 8/1981 | Collura | 53/48 |

FOREIGN PATENT DOCUMENTS

| | | | |
|---|---|---|---|
| 1346757 | 2/1974 | United Kingdom | 53/534 |

*Primary Examiner*—John Sipos

*Attorney, Agent, or Firm*—Rodgers & Rodgers

[57] ABSTRACT

Set-up open top bottle carriers having apertured bottom walls are continuously supplied in abutting relationship by conveyor means to a loading station while bottles are moved continuously along a dead plate having its outfeed end at said loading station, and a plurality of positioning pins mounted on endless means which is movable in synchronism with movement of the bottles along the dead plate are disposed below the outfeed end of the dead plate and arranged so that the positioning pins enter apertures in the bottoms of the cartons thereby to insure that bottles fed off of the outfeed ends of the dead plate are dropped into the carton therebelow, the bottles being guided during their downward fall into the carton by parts of the pusher means which moves the bottles along the dead plate and downward movement of the bottles being arrested by a cushioned stop due to engagement with the positioning pins which are yieldably mounted.

5 Claims, 7 Drawing Figures

15
27
29
27a
B1
B2
B3
B4
B5
B6
B7
B8
B9
C6
C7
C8
C9
C10
EC
OE
21b
P
P1
20a
23
24
19
18
21
20
22
17

METHOD AND APPARATUS FOR LOADING BOTTLES INTO OPEN TOP BOTTLE CARRIERS

TECHNICAL FIELD

This invention relates to a method and apparatus for automatically loading bottles into open ended carriers at high speeds. Cooperation between the bottles and the machine elements which manipulate the bottles effectively precludes damage to the bottles or to their labels.

BACKGROUND ART

U.S. patent application Ser. No. 161,799 filed June 23, 1980 now U.S. Pat. No. 4,332,123 and owned by the assignee of this invention discloses a bottle loading machine wherein a series of open top carriers are moved along a horizontal path and wherein bottles fed along a downwardly inclined path disposed above the path of movement of the carriers are gripped individually by suitable movable gripper means which lowers the bottles into the carriers and thereafter releases the bottles. While this machine operates satisfactorily for many applications, it is not well suited for use in conjunction with bottles having neck portions which are covered with decorative paper, foil or the like because of damage to such coverings.

U.S. Pat. No. 3,481,108 discloses a movable loading grid having groups of guide fingers which extend into the cells of open top cartons so as to allow loading of the cartons off of the end of a dead plate. In this arrangement the movable loading grid does not feed the bottles into a loading station.

U.S. Pat. No. 3,377,774 discloses a device for loading articles into an open top container in which means are provided for tilting the articles outwardly before being dropped into the container while the container is being moved.

U.S. Pat. No. 3,478,491 discloses a continuous loading operation wherein articles to be loaded are fed downwardly into open top containers through a series of stepped guides so as to effect a cascading downward movement of the articles.

U.S. Pat. No. 3,653,178 discloses an intermittently operable mechanism wherein a platform is provided with upwardly extending fingers which enter holes in the bottom wall of a case to be loaded for the purpose of engaging and cushioning the fall of bottles during a loading operation.

DISCLOSURE OF THE INVENTION

According to this invention in one form, open top bottle carriers are fed continuously to a loading station where a series of positioning pins are arranged to enter apertures formed in the bottom walls of the cartons so as to move the cartons through the loading station and bottles arranged in at least one row are fed along a dead plate whose outfeed end is located at the loading station and the bottles are moved along the dead plate toward its outfeed end by pusher means whose movement is synchronized with movement of the positioning pins and of the movement of the carriers through the loading station so that, as bottles individually slide off the out feed end of the dead plate, they drop into the open top carriers moving therebelow, the bottles being guided during their downward movement by parts of the pusher means and their fall into the carton being cushioned by engagement with the positioning pins which at this stage of the operation are yieldably mounted.

When the invention is used to load two rows of bottles simultaneously into the cells on opposite sides of the carrier handle, the rows are separated by a panel which is specially constructed to cooperate with the pusher means so as to facilitate entry of the carrier handles between the rows of bottles so that subsequent drop loading of the bottles can be effected without having the carrier handle to obstruct bottle loading. Thus the carrier handles facilitate rather than hinder bottle loading because they aid in maintaining proper relative positions of the carrier and bottles.

BEST MODE OF CARRYING OUT THE INVENTION

Figure 1:
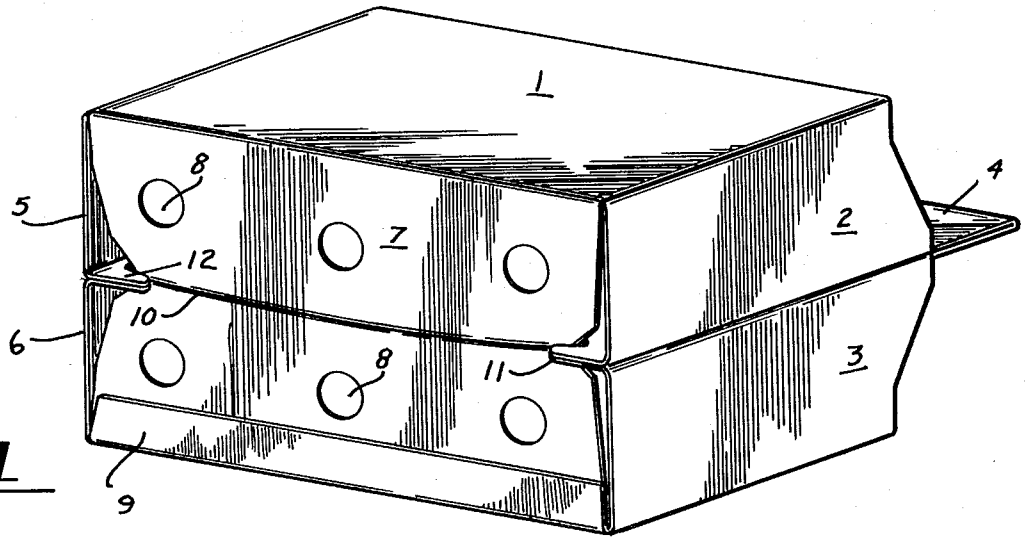
FIG. 1 is an isometric view from below of a bottle carrier of the open top basket style having apertures formed in is bottom wall.

While this invention is not limited to a particular type of carrier, it is well suited for use with a carrier of the well known type disclosed in FIG. 1 wherein the carrier comprises a side wall 1, end wall panels 2 and 3, medial handle 4, end wall panels 5 and 6, bottom panel 7 having apertures 8 formed therein together with a side wall opposite the side wall 1 which is not observable in the drawing but to the bottom edge of which a glue flap 9 is foldably joined and adhered to bottom wall 7. Bottom wall 7 is collapsible along a medial fold line 10 and the carrier is held in set-up condition by a pair of projections 11 and 12 which are foldably secured in known manner to the end panels 2 and 3 on the one hand and 5 and 6 on the other.

Figure 2:
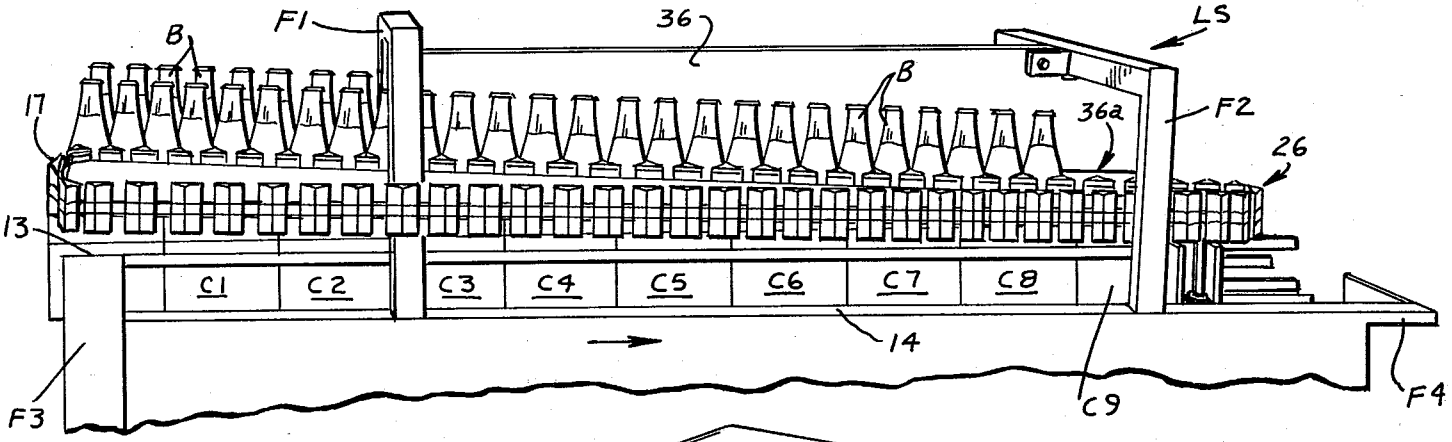
FIG. 2 is an overall side view of bottle carrier loading apparatus formed according to this invention.
Figure 4:
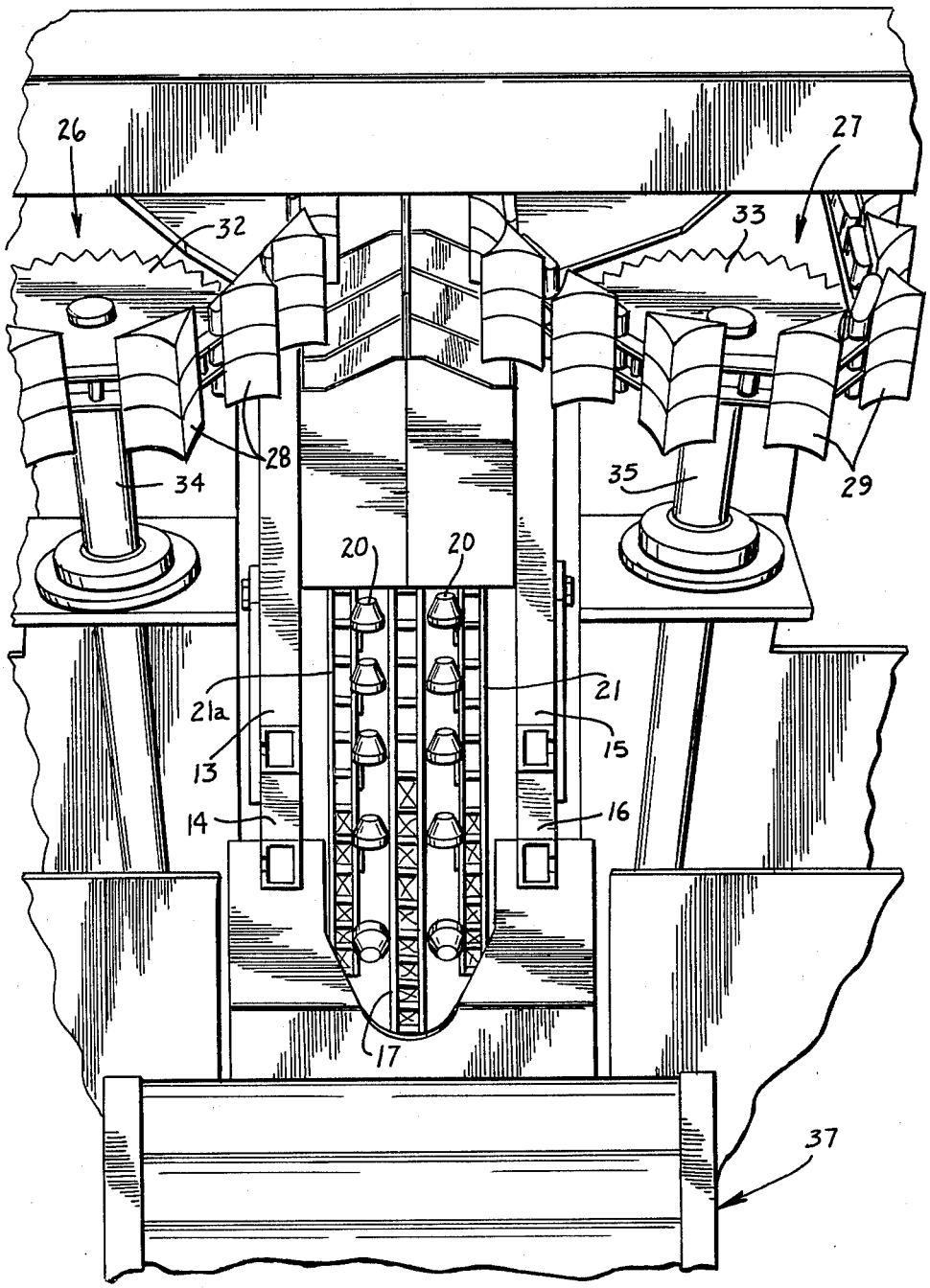
FIG. 4 is a perspective view of the outfeed end of the machine showing the positioning pins and associated apparatus as well as the pusher means formed according to this invention.

As is shown in FIG. 2, cartons C1–C9 are fed from left to right along a generally horizontal path to a loading station generally indicated at LS. During movement of the carriers toward the loading station, the carriers are guided by a pair of guides 13 and 14 on one side and 15 and 16 on the opposite side as best shown in FIG. 4. Movement of the carriers from left to right is imparted by conveyor means in the form of an endless chain 17 supported by driving sprocket 18 mounted on drive shaft 19. Of course the conveyor chain 17 is supported by an idler sprocket at its left hand end as viewed in FIGS. 2 and 5 but which has been omitted for clarity.

Figure 5:
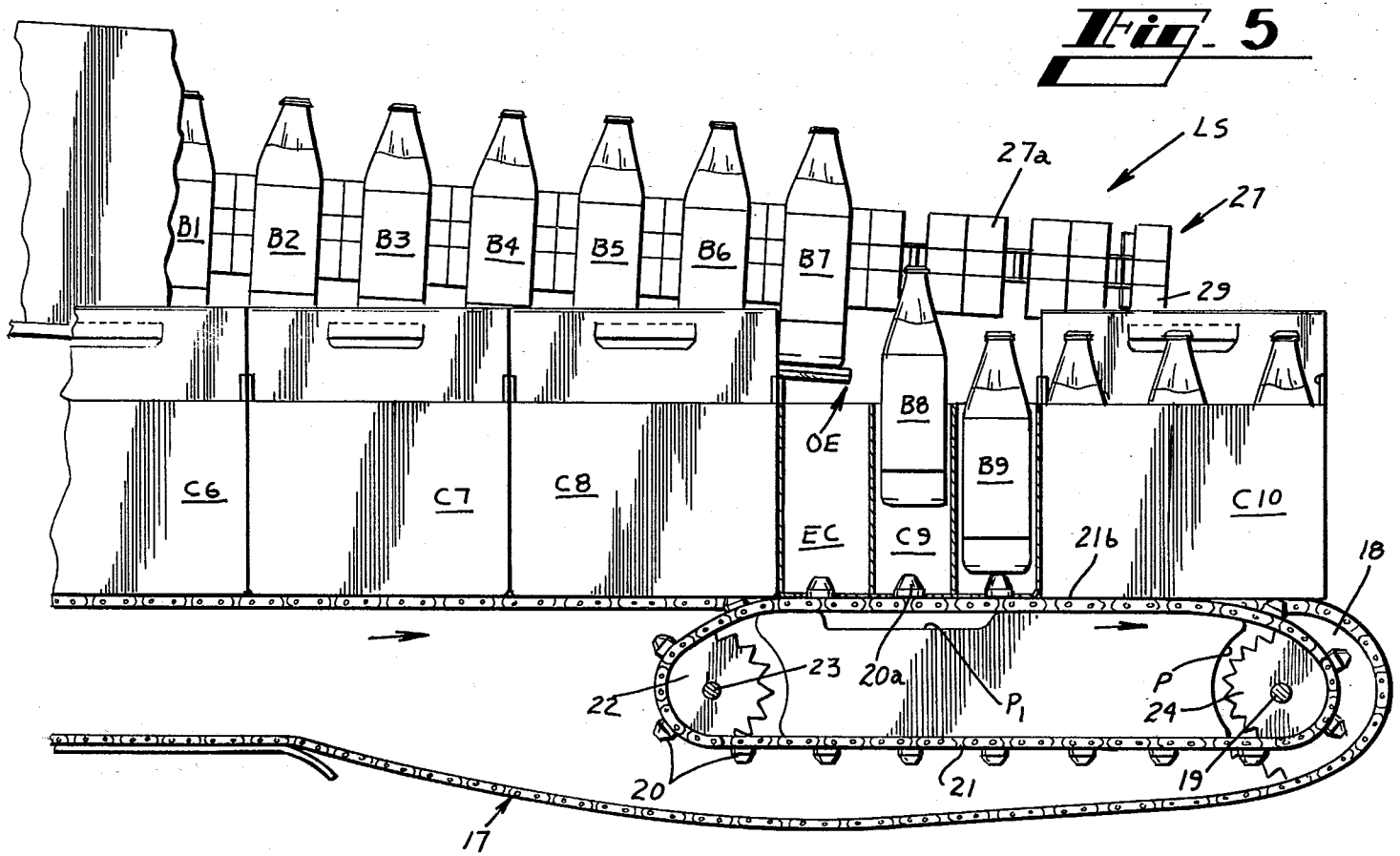
FIG. 5 is an enlarged side view of a part of the outfeed end of the machine showing the loading station and with parts broken away so as to show the relationship of the bottles and carriers during a loading operation.

As is best shown in FIG. 5 the carriers are conveyed by conveyor chain 17 to synchronized positioning pins 20 which are mounted on and movable with endless movable means 21 and 21*a* driven by driving sprocket 22 mounted on drive shaft 23. Chains 21 and 21*a* are supported at their right hand ends by sprockets such as 24 idling on shaft 19 and by plate P having cutout P1 along its top edge.

As the carton C8 best shown in FIG. 5 moves into the position designated C9 in FIG. 5, the positioning pins 20 enter corresponding apertures 8 formed in the bottom of the carrier located at position C9. The carrier located at position designated C9 is located at the loading station LS.

For the purpose of supporting the bottles being fed into the loading station LS and for facilitating loading of the bottles into the carriers, dead plates 25 and 25*a* are provided and as is best shown in FIG. 5 are tilted downwardly toward the right in the direction of movement of the carriers and of the bottles as well. The handles of the carriers are received between the two rows of bottles as the movement progresses. While the invention is shown and described as applicable to two rows of bottles and to carriers having a row of cells on each side of the handle, the invention can be applied to a different number of rows of bottles and carrier cells.

Figure 3:
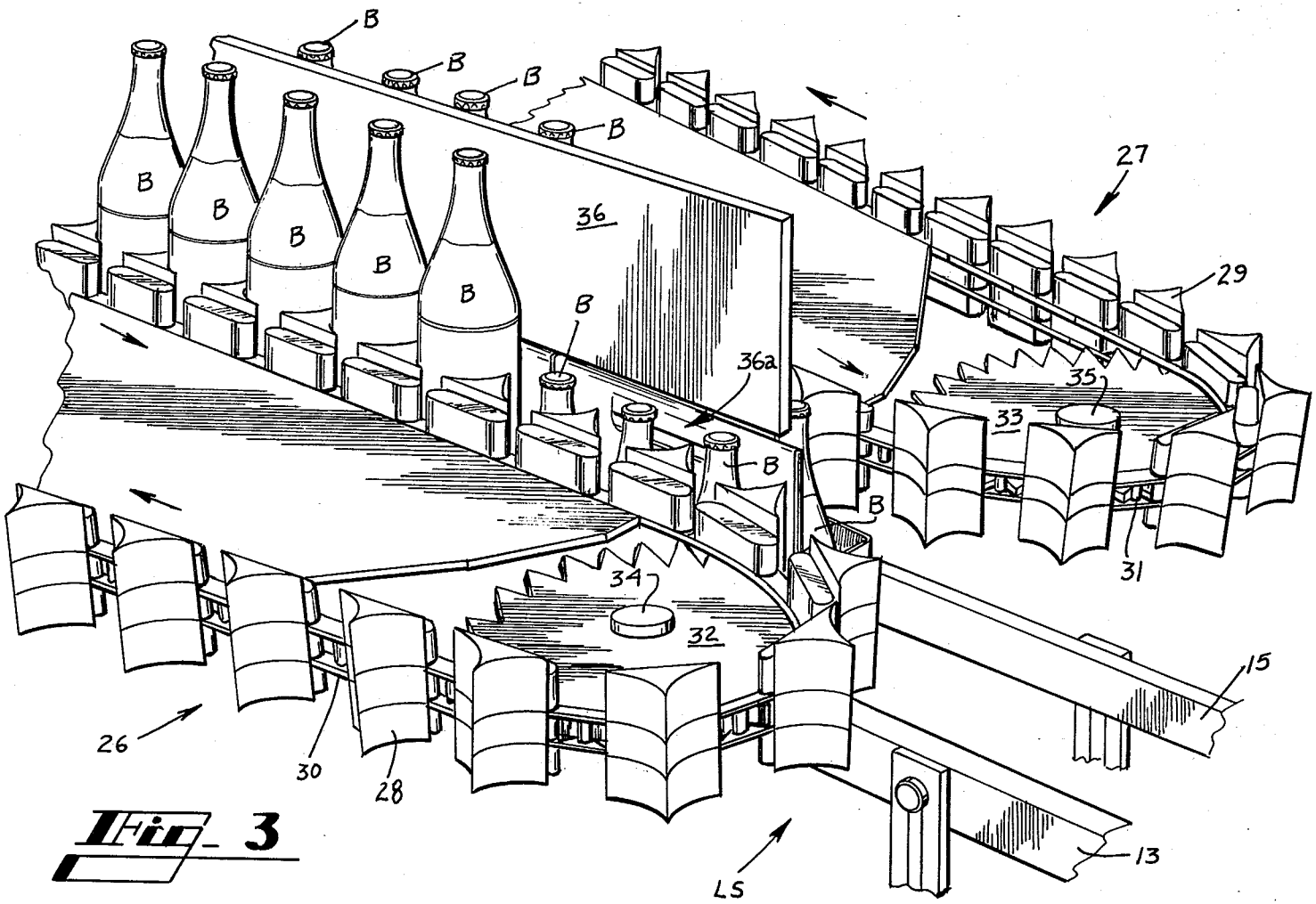
FIG. 3 is a perspective view of a part of the outfeed end of the mechanism shown in FIG. 2 and which discloses the pusher means formed according to this invention.

For the purpose of feeding the bottles to the loading station, pusher means best shown in FIG. 3 and designated by the numerals 26 and 27 are provided. These pusher means comprise a plurality of wedge shaped pusher elements such as that designated at 28 and 29. These pusher elements are mounted on endless chains 30 and 31 respectively which in turn are driven by sprockets 32 and 33 mounted on substantially vertical shafts 34 and 35. The pusher means extend beyond the outfeed end of the dead plates to positions above the carriers. Pusher means 26 and 27 are separated by a fixed wall panel 36 so that the bottles on the near side of panel 36 are pushed generally from left to right by pusher means 26 while the bottles located on the far side of wall panel 36 are fed from left to right by pusher means 27 into the loading station located generally as indicated at LS. Wall panel 36 as is best shown in FIG. 2 is fixed in position and supported in any suitable manner by frame elements F1 and F2 while the conveyor chain 17 and parts associated therewith as well as the pusher means 26 and 27 and associated parts are suitably supported by frame structures F3, F4, and other frame elements omitted for clarity.

According to one feature of this invention, the pusher means 26 and 27 are both driven in synchronism with the endless elements 21 and 21*a*. Thus with the outfeed end OE of dead plate 25 disposed as shown in FIG. 5, a bottle such as that indicated at B7 in FIG. 5 is moved off of the outfeed end OE of the dead plate 25 when the left hand end cell EC of carrier C9 is disposed below the end OE of dead plate 25 and in such a position that the bottle such as B7 slides off of the outfeed end OE and is lodged in the end cell EC.

For the sake of clarity the row of bottles being pushed by the pusher means 27 is shown so that the bottles loaded into the carrier C9 are loaded into cells on the far side of the carrier C9. Of course bottles are loaded simultaneously into the near side of carrier C9.

Figure 6:
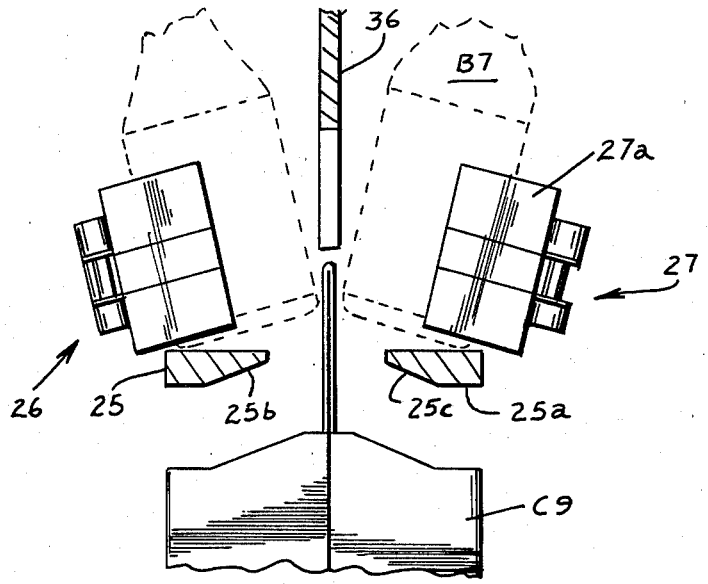
FIG. 6 is an enlarged fragmentary end view of a portion of the machine showing the bottles just before they are dropped off the outfeed end of a dead plate and FIG. 7 is an enlarged end view in section which shows a pair of bottles after they have been loaded into a carrier and while they are still supported by the yieldable positioning pins.
Figure 7:
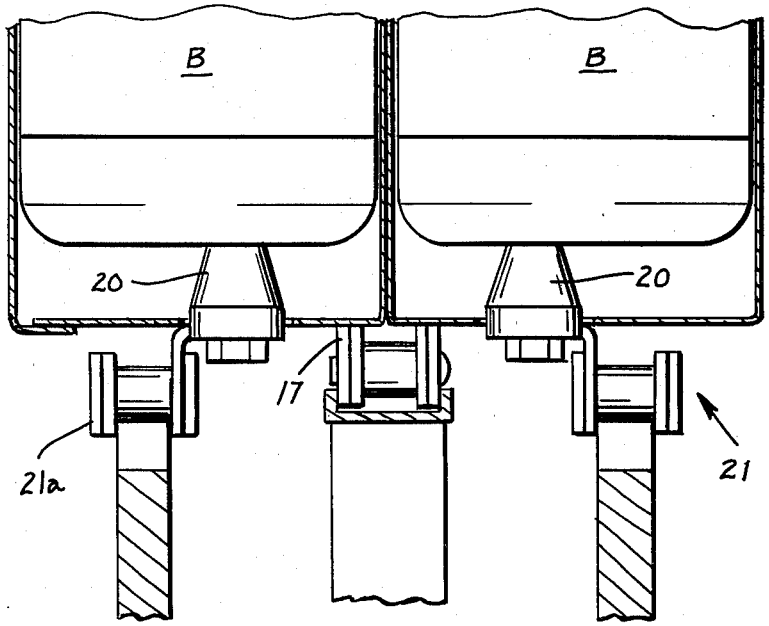

The wedge shaped elements such as 28 and 29 are constructed so that their dimension in a generally vertical direction is substantial with reference to the height of the bottles so that the pusher element such as 27*a* in FIG. 5 is disposed ahead of bottle B7 and prevents forward toppling of bottle B7 and thus serves to guide the bottle downwardly into cell EC and also pushes bottle such as B8 off of the dead plate. As is apparent from FIG. 5 dead plate 25 is inclined downwardly toward the right in the direction of movement of the bottles so that the cross sectional area of the bottom of bottle such as B7 is generally slightly elliptical in configuration in a horizontal plane and thus by this means entry of the bottle B7 into the cell EC is facilitated by effectively making the bottom of the bottles smaller relative to the size of cell EC since carrier C9 is on a horizontal support. In like fashion, the bottles are tilted outwardly for a similar reason and this phenomenon is depicted in FIG. 6 as is obvious. Of course bottles on both sides of the wall panel 36 are tilted outwardly as is apparent from FIG. 6. Outward tilting of the bottles is caused by the fact that the panel 36 is cutaway at its lower right corner 36*a* as viewed in FIG. 3 and because the pushers 26 and 27 converge alongside the cutaway area 36*a*. Space for the carrier handles is provided by the position of panel 36 which is upstream of the cutaway area 36*a* and the handles are guided upwardly between the bottle heels by the bevelled surfaces 25*b* and 25*c*. Once the handle of a carrier is disposed between the two rows of bottles it is securely held in a medial position where it cannot obstruct the loading of the bottles into a carrier.

For the purpose of arresting downward movement of the bottles into the carrier by means of a cushioned stop, the endless means 21 and 21*a* are arranged so that the mid portion of their upper reaches 21*b* are disposed between their associated sprockets such as 22 and 24 so that when a bottle such as B9 engages a positioning pin such as 20*a*, the upper reach 21*b* is adapted to yield and to move downwardly somewhat due to the fact that the tension of endless element 21 is such as to allow this action to take place. Thus by this means downward movement of the bottles is cushioned. Of course when a loaded carton such as C10 is moved toward the right off of the endless means 21 and 21*a*, it is then disposed on a suitable conventional conveyor such as is indicated for example generally at 37.

INDUSTRIAL APPLICABILITY

The method and apparatus of this invention are specially adapted for use in conjunction with high speed loading of open top carriers with bottles such as are used to package soft drinks, beer and the like.

What is claimed is:

1. A bottle carrier loading machine comprising conveyor means having upper and lower reaches for continuously supplying to a loading station a series of set-up multiple cell bottle carriers arranged in abutting contact, the bottom of each cell having an aperture formed therein, a fixed dead plate disposed above the path of movement of said carriers and having its outfeed end at said loading station, pusher means including a series of generally wedge shaped pusher elements mounted on endless means disposed above said dead plate and arranged to supply to said loading station a continuous series of bottles slidable on said dead plate and in generally upright side-by-side relation, each pusher element being arranged to engage and to push a preceding bottle toward the outfeed end of said dead plate and to engage and guide a succeeding bottle downwardly as it drops off of the outfeed end of said dead plate, a plurality of movable positioning pins arranged respectively to enter corresponding apertures in the bottoms of the carrier cells so as to move the carriers through the loading station in such manner that the carriers receive bottles as they slide off of the outfeed end of said dead plate, said positioning pins being mounted on endless means the upper reach of which at the location where the bottles contact the pins is unsupported throughout its entire width and somewhat yieldable intermediate its ends so that downward movement of the bottles is arrested by a cushioned stop due to engagement of the bottles with the positioning pins at the unsupported portion of the conveyor intermediate the ends of the upper reach of said endless means.

2. A loading machine according to claim 1 wherein movement of said carrier positioning pins is synchronized with movement of said pusher means.

3. A loading machine according to claim 1 wherein each carrier includes a medial longitudinal partition and a row of cells on each side of the partition and wherein said pusher means comprises two series of pusher elements arranged to engage and to feed two rows of bottles into each row of cells respectively and wherein a vertical wall panel is fixedly mounted above said dead plate and between said two series of pusher elements and above said longitudinal partitions so as to separate the two rows of bottles.

4. A loading machine according to claim 1 wherein each of said pusher elements is formed so that its dimension in a generally vertical direction is substantial relative to the height of the bottles so as to facilitate guiding of the bottles and to prevent toppling thereof as the bottles slide off of the outfeed end of the dead plate.

5. A loading machine according to claim 1 wherein said dead plate and said pusher means are inclined downwardly somewhat in the direction of carrier and bottle movement toward and through said loading station so as to tilt the bottles forwardly and thereby to facilitate entry of the bottles into the carrier cells respectively while the carriers and bottles converge.

* * * * *